US005306049A

United States Patent [19]

Schireck

[11] Patent Number: 5,306,049

[45] Date of Patent: Apr. 26, 1994

[54] SPORTS MEMORABILIA AUTHENTICATION KIT

[76] Inventor: John W. Schireck, 2251 San Ramon Valley Blvd., San Ramon, Calif. 94583

[21] Appl. No.: 119,305

[22] Filed: Sep. 13, 1993

[51] Int. Cl.[5] ..... B65D 69/00; G09F 3/00

[52] U.S. Cl. ..... 283/74; 283/56; 206/232; 206/579

[58] Field of Search ..... 283/74, 78, 56, 117, 283/68, 69; 206/579, 575, 232; 273/60 R, 60 A, 72 R; 40/327

[56] References Cited

U.S. PATENT DOCUMENTS

| | | | |
|---|---|---|---|
| 1,560,047 | 11/1925 | Edwards | 283/69 |
| 5,082,110 | 1/1992 | Hager | 206/232 |
| 5,190,127 | 3/1993 | Cummings | 206/579 |

*Primary Examiner*—Hwei-Siu Payer

*Attorney, Agent, or Firm*—Bielen, Peterson & Lampe

[57] ABSTRACT

A sports memorabilia authentication kit in which a collectable sports item is marked with an original thumbprint of the sports figure associated with the item and an authentication card having a duplicate original print together with other identifying indicia to identify the sports figure.

7 Claims, 1 Drawing Sheet

SPORTS MEMORABILIA AUTHENTICATION KIT

BACKGROUND OF THE INVENTION

This invention relates to sports memorabilia and a system to authenticate or certify that the sports item is a genuine item or one that is a signatory item signed or authenticated by the sports figure to which the item is related.

Collecting sports items is a popular hobby that has financial rewards. Trading cards, including baseball cards, football cards, basketball cards, hockey cards, and other such sportscards, have for years comprised the core for a large loose-knit organization of collectors who collect sports related items. These items can typically run from printed media such as programs, posters and photographs to physical items such as balls, bats, jerseys and other sports related equipment.

The value of such items, customarily is greatly enhanced by the autograph of the player or other notable individual such as coach or team owner, to which the item is related.

However, autographs are becoming commonplace and the assurance that an autograph is a genuine signature is increasingly difficult to determine. High resolution duplication and printing and automatic signature machines make it difficult to determine if the signature is an actual signature or only a reproduction, even where the apparent autograph is authorized on an authorized product or collectable item. To the collector, who often places sentimental value on an item, the difference between an actual signature, where the notable sports individual handled the item, and one simply duplicated, even where the market value is the same, may be considerable.

There is therefore needed, a system that will provide a means for authentication of a sports item as a genuine item, and one that is likely to enhance the value of the item authenticated because of a personal touch.

The sports memorabilia authentication kit of this invention solves these problems and provides a new class of sports items that can be collected.

SUMMARY OF THE INVENTION

This invention relates to an authentication kit particularly designed for sports memorabilia. The sports memorabilia authentication kit provides a system for authenticating the association of a sports collectable item with a particular sports figure. Generally, collectable sports memorabilia can comprise a variety of different items related to sports and particularly to notable sports individuals. For example, a collectable item may be a program, a poster, sporting apparel or items associated with a sport, such as a baseball, a bat, a hockey stick or other item of equipment. Additionally, collectable sports trading cards for various sports such as baseball cards, football cards, basketball cards and other such sportscards customarily feature a sports figure such as a player or coach. The value of such sports related items are often enhanced by the signature of the player.

However, because of the advances in printing techniques and automatic writing machines, the signature of a sports figure can be duplicated with such accuracy that is difficult to discern whether the signature is authentic. Furthermore, it is sometimes difficult to induce a sports figure to sign a large number of items, which is time consuming and tiring. While the authentication kit of this invention preferably includes the signature of the sports individual, it may be omitted and the authentication kit provides sufficient identifying means to certify the association of the authenticated item with the sports figure.

The sports memorabilia authentication kit of this invention includes a collectable sports items bearing an actual fingerprint, preferably the thumb print, of the sports individual thereon and a certification card which also includes a similar print and the identification of the player. The print is located at a prominently viable place on the collectable item and can be visibly compared with the print on the certification card. Both prints are originals and slight variations due to orientation and pressure will be apparent. The certification card also includes other identifying markings and indicia, and in the preferred embodiment includes the identity of the individual in the form of a picture and printed an autograph signature, the sequence number and edition run number, a unique identification number in the form of a serial number, and a source identification to indicate the origin of the certification card. The certification is in the form of the duplicate original print on the certification card that can be visibly compared with the print on the collectable item. A copy of this print is retained by the originating source and can be compared with the prints on the certification card and collectable item for verification. These and other features of the invention will become apparent from a consideration of the detailed description of the preferred embodiments.

DETAILED DESCRIPTION OF THE PREFERRED EMBODIMENTS

Figure 1:
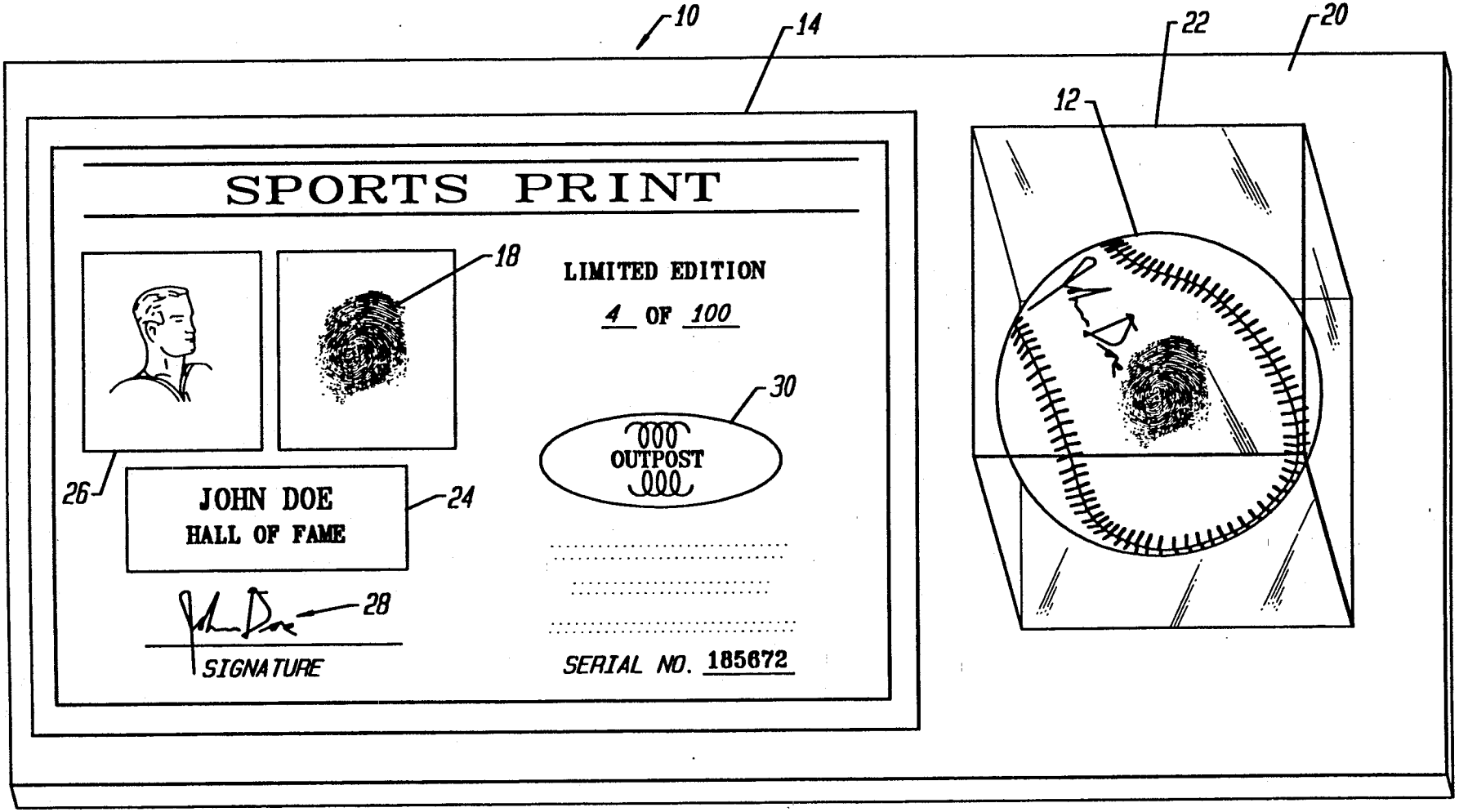
FIG. 1 is a perspective view of a collectable sports item and authentication card mounted on a plaque.

Referring to the drawing, FIG. 1 shows one embodiment of the sports memorabilia authentication kit designated by the reference numeral 10. The authentication kit includes a collectable sports item 12 here a baseball, in combination with a certification card 14. The sports item 12 and certification card each include a fingerprint, 16 and 18, here a thumb print, which because of its larger size is preferred as the print identification means. Each print 16 and 18 is a duplicate original and may be slightly different because of orientation and pressure during personal application by the notable sports figure.

The authentication kit shown includes a plaque 20 to which the collectable sports item 12 and authentication card 14 are mounted. This is not an essential part of the invention and may be impractical, for example, where the collectable item is a bat or other large item. The collectable item 12 is shown in a protective, clear plastic case 22 with the print 16 positioned for visibility. The preferred embodiment of the certification card includes identification indicia of the sports figure in the form of a printed name 24 and a picture 26 of the individual. As an added bonus, the certification card includes an authentic signature 28 of the sports figure.

The certification card 14 includes indicia 30 indicating the source and origin of the card 14. The source indicia 30 is in the form of a logo, but can be any type of means to relate the authentication kit to a registry, (not shown) which can simply be a photocopy of the card and photo of the item. Naturally, the registry can be a more sophisticated means of tracking and recording the authentication such as a digitized file in a relational database including a digitized image of the fingerprint and fields for the other identifying indicia including the identity of the type of sports item included in the collector kit. These items can be integrated into a digitized sportscard.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A sports memorabilia authentication kit comprising:

a sport collectable item, wherein the sport collectable item has a discernable fingerprint from a notable sports individual thereon, a sports certification card, wherein the sports certification card has a substantially identical fingerprint from the notable sports individual thereon, wherein the certification card includes additional indicia identifying the sports individual.

2. The sports memorabilia kit of claim 1 wherein the certification card includes numerical indicia indicative of an edition run and indicia indicating the rank of the collectable item in the edition run.

3. The sports memorabilia kit of claim 1 wherein the certification card includes the signature of the sports individual who placed his fingerprint on the collectable item and the certification card.

4. The sports memorabilia kit of claim 1 wherein the fingerprint is a thumbprint.

5. The sports memorabilia kit of claim 1 wherein the certification card includes a unique identification number thereon.

6. The sports memorabilia kit of claim 1 wherein the collectable item and the certification card are mounted on a decorative plaque.

7. The sports memorabilia kit of claim 1 wherein the certification card includes indicia thereon indicative of the source of the card.

* * * * *